US012390677B2

(12) United States Patent
Liu et al.

(10) Patent No.: US 12,390,677 B2
(45) Date of Patent: Aug. 19, 2025

(54) TRAMPOLINE AND ELASTIC SYSTEM

(71) Applicant: Dazhong Liu, Beijing (CN)

(72) Inventors: Dazhong Liu, Beijing (CN); Ziyang Liu, Beijing (CN)

(73) Assignee: Dazhong Liu, Beijing (CN)

( * ) Notice: Subject to any disclaimer, the term of this patent is extended or adjusted under 35 U.S.C. 154(b) by 85 days.

(21) Appl. No.: 18/413,673

(22) Filed: Jan. 16, 2024

(65) Prior Publication Data

US 2025/0121242 A1 Apr. 17, 2025

(30) Foreign Application Priority Data

Oct. 12, 2023 (CN) ..... 202311321684.0

(51) Int. Cl.
*A63B 5/11* (2006.01)
*A63B 21/02* (2006.01)
*A63B 21/045* (2006.01)

(52) U.S. Cl.
CPC ..... *A63B 5/11* (2013.01); *A63B 21/026* (2013.01); *A63B 21/045* (2013.01)

(58) Field of Classification Search
CPC ..... A63B 5/11; A63B 21/026; A63B 21/045; A63B 5/00; A63B 5/08; A63B 5/10; A63B 5/12; A63B 5/16; A63B 6/00; A63B 6/02; A63B 2209/00; A63B 71/0054
See application file for complete search history.

(56) References Cited

U.S. PATENT DOCUMENTS 2,635,886 A * 4/1953 Schoebel ..... A63G 19/02 280/1.183
3,466,031 A * 9/1969 Boykin, Jr. ..... A63B 5/11 482/27
3,983,585 A * 10/1976 Sidlinger ..... A63B 5/11 182/139
4,199,136 A * 4/1980 Mansfield ..... A63B 5/08 482/26
4,331,329 A * 5/1982 Mirkovich ..... A63B 5/11 482/27
5,562,575 A * 10/1996 Gvoich ..... A63B 21/4029 482/52
5,565,003 A * 10/1996 Gerstung ..... A63B 5/08 482/26
5,816,956 A * 10/1998 Ellis ..... A63B 61/00 473/492

(Continued)

*Primary Examiner* — Garrett K Atkinson
(74) *Attorney, Agent, or Firm* — COZEN O'CONNOR

(57) ABSTRACT

A trampoline includes an elastic assembly, wherein a portion of the elastic assembly is a bendable energy accumulator; and an elastic support including vertical supporting units and a horizontal supporting unit, two vertical supporting units are arranged at intervals on the horizontal supporting unit, the two vertical supporting units are respectively connected with the first end and the second end to bilaterally support and pre-tension the elastic assembly, and the elastic assembly, when being subjected to a bending deformation, is capable of making at least one of the vertical supporting units and the horizontal supporting unit to be subjected to an elastic bending deformation, so as to apply symmetrical elastic reset force to the first end and the second end, and limit a change of a horizontal distance between the first end and the second end.

20 Claims, 8 Drawing Sheets

(56) References Cited

U.S. PATENT DOCUMENTS 6,001,045 A * 12/1999 Gift ..... A63B 5/11 482/28
6,017,292 A * 1/2000 Gift ..... A63B 5/11 482/28
6,139,474 A * 10/2000 Gift ..... A63B 71/0054 482/28
7,331,903 B2 * 2/2008 Nissen ..... A63B 67/002 482/27
8,668,190 B1 * 3/2014 Heruska ..... A63B 5/11 248/548
9,358,412 B2 * 6/2016 Nelson ..... A63B 21/023
9,682,264 B1 * 6/2017 Chen ..... A63B 71/0054
10,232,208 B2 * 3/2019 Chen ..... A63B 71/022
10,434,350 B2 * 10/2019 Chen ..... A63B 71/04
11,285,370 B2 * 3/2022 Shorma ..... A63B 6/00
2002/0137598 A1 * 9/2002 Publicover ..... A63B 5/11 482/27
2004/0107491 A1 * 6/2004 Publicover ..... E04H 4/108 4/498
2005/0032609 A1 * 2/2005 Nissen ..... A63B 5/11 482/27
2007/0004559 A1 * 1/2007 Alexander ..... A63B 5/11 482/27
2008/0269020 A1 * 10/2008 Alexander ..... A63B 5/11 482/29
2009/0264042 A1 * 10/2009 Chen ..... A63G 31/12 446/221
2014/0094327 A1 * 4/2014 Freund ..... A63B 69/0097 29/428
2014/0179492 A1 * 6/2014 Wilkins ..... A63B 71/0619 482/27
2016/0030794 A1 * 2/2016 Yang ..... A63B 5/11 482/28
2016/0096055 A1 * 4/2016 Smock ..... A63B 71/022 482/27
2016/0296781 A1 * 10/2016 Andon ..... A63B 5/11
2017/0173437 A1 * 6/2017 Chen ..... A63B 5/11
2018/0036569 A1 * 2/2018 Chen ..... A63B 71/0054
2018/0036570 A1 * 2/2018 Chen ..... A63B 71/022
2018/0290000 A1 * 10/2018 Chen ..... A63B 71/022
2025/0121242 A1 * 4/2025 Liu ..... A63B 21/026
2025/0121243 A1 * 4/2025 Liu ..... A63B 5/11

* cited by examiner

TRAMPOLINE AND ELASTIC SYSTEM

CROSS-REFERENCE TO RELATED APPLICATION

This patent application claims the benefit and priority of Chinese Patent Application No. 202311321684.0 filed with the China National Intellectual Property Administration on Oct. 12, 2023, the disclosure of which is incorporated by reference herein in its entirety as part of the present application.

TECHNICAL FIELD

The present disclosure belongs to the field of sports equipment, relates to an instrument for bouncing, in particular to a trampoline and an elastic system.

BACKGROUND

The trampoline, as sports and entertainment equipment, is loved by people, especially children and young people. However, the trampoline is too soft to stand firm, and is not suitable for middle-aged and elderly people. The cantilever springboard for diving is easy to stand firm, but is too huge and complex for indoor jumping. In the Chinese patent with the publication number of CN102553128A, a spring-supported rigid plate, as a jumping exerciser, is limited by the linear characteristics of compression springs and can affect the sense of sports. In the American patent with the publication number of U.S. Pat. No. 4,199,136A, an elastically bendable semi-rigid plate is used as elastic component. However, the supporting problem of plate end turning angles and plate end distance shortening caused by plate bending cannot be completely solved, so that the fluctuating range of the plate can be limited, and friction noise is easily generated. Similar to a trampoline structure, in the American patent with the publication number of U.S. Pat. No. 4,037,834A, disclosed is a jogging platform with a spring structure. Four-sided tension springs are used to hang plywood. The four-sided tensioned plywood just serves as a pedal platform, but cannot be bent effectively, mainly relying on tension springs to store energy, so that the elastic effects of deep bending and effective energy storage of the pedal cannot be achieved.

SUMMARY

The present disclosure aims to provide a novel trampoline and an elastic system. Through a bilaterally and elastically supported elastic assembly, the elastic performance of the trampoline can be improved, and the problems of the turning angles at both supported ends of the elastic plate and the change of the horizontal distance between both supported ends of the elastic plate due to the bending of the elastic assembly so as to limit the fluctuating amplitude of the elastic assembly and easily generate the friction noise in the prior art can also be solved.

In order to achieve the purpose, the present disclosure provides the following scheme.

The present disclosure provides a trampoline, including:

an elastic assembly having a first end and a second end, wherein a part, located between the first end and the second end, of the elastic plate is a bendable energy accumulator; and an elastic support including vertical supporting units and a horizontal supporting unit, wherein two of the vertical supporting units are separately arranged on the horizontal supporting unit, the two vertical supporting units are respectively connected with the first end and the second end of the elastic assembly via connecting units to bilaterally support and pre-tension the elastic assembly, and the elastic assembly, when being subjected to a bending deformation, is capable of making at least one of the vertical supporting units and the horizontal supporting unit to be subjected to an elastic bending deformation, so as to apply symmetrical elastic reset force to the first end and the second end of the elastic assembly, and limit a change of a horizontal distance between the first end and the second end during the bending deformation of the elastic assembly.

Optionally, the horizontal supporting unit is a horizontal elastic support plate or a horizontal elastic support frame including bar frames. The vertical supporting unit is a vertical elastic support plate or a vertical elastic support frame including bar frames, and the vertical supporting units are symmetrically arranged at both ends of the horizontal support unit to form a U-shaped elastic support.

Optionally, the vertical supporting units and the horizontal supporting unit are integrally formed; or, the vertical supporting units and the horizontal supporting unit are connected through torsion springs or bending leaf springs.

Optionally, the trampoline further includes elastic legs. The elastic legs are arranged at the bottom of the elastic support so as to support the elastic support, and when the elastic assembly is subjected to a bending deformation, the elastic legs are subjected to an elastic bending deformation or a vertical elastic deformation.

Optionally, the elastic assembly is a rectangular elastic flat plate, both ends of the rectangular elastic flat plate in a length direction are the first end and the second end respectively, and the rectangular elastic flat plate has a uniform thickness, or has a thickness which is gradually reduced from middle to both ends in the length direction.

Or, the elastic assembly is an arched elastic plate, a vertical projection of the arched elastic plate is rectangular, both ends of the arched elastic plate in the length direction are the first end and the second end respectively, and the arched elastic plate has a uniform thickness, or has a thickness which is gradually reduced from the middle to both ends in the length direction.

Or, the elastic assembly comprises a rectangular elastic frame, a plurality of supporting crossbars arranged at intervals along a length direction of the rectangular elastic frame are embedded inside the rectangular elastic frame, the rectangular elastic frame is internally covered with an elastic thin plate or elastic fabric, and both ends of the rectangular elastic frame in the length direction are the first end and the second end respectively.

Optionally, the trampoline also includes at least one of a bottom reinforcing structure, a top reinforcing structure and a top surface buffer structure, wherein the bottom reinforcing structure includes reinforcing ribs, a reinforcing plate and/or a fabric pulling reinforcing net and a belt arranged on a bottom surface of the elastic assembly; the top reinforcing structure includes reinforcing ribs and/or a reinforcing plate arranged on a top surface of the elastic assembly; and the top surface buffer structure includes a polymer material buffer layer or a fabric buffer layer arranged on the top surface of the elastic assembly.

Optionally, the first end and the second end of the elastic assembly are connected with respective vertical supporting units through two connecting units respectively; any one of the two connecting units is one of a hinged connector, an elastic corner connector and a flexible corner connector.

One end of the hinged connector is connected with the first end or the second end of the elastic assembly, an other end of the hinged connector is connected with a corresponding one of the vertical supporting units, the first end or the second end of the elastic assembly are hinged with the corresponding one of the vertical supporting units through the hinged connector.

The elastic corner connector is a polymer elastic component or a metal elastic component, one end of the elastic corner connector is connected with the first end or the second end of the elastic assembly, an other end of the elastic corner connector is connected with a corresponding one of the vertical supporting units, and both ends of each elastic corner connector are capable of being elastically deformed by external forces.

The flexible corner connector is a connecting chain, a connecting rope or a connecting belt, a fixed end of the flexible corner connector is directly connected with a corresponding one of the vertical supporting units or is connected with the corresponding one of the vertical supporting units through a spring, an adjusting end of the flexible corner connector penetrates through a connecting hole of the first end or the second end and then turns over to the fixed end, and is connected with the fixed end through a buckle to adjust a length and tightness of the flexible corner connector.

Optionally, the elastic assembly is provided with an electronic counter or a vibration sensor so as to count number of bending deformation of the elastic assembly.

Optionally, the elastic assembly is also provided with at least one of a stool, a chair and a saddle seat; and the elastic support is also provided with a follow-up armrest.

The present disclosure provides an elastic system including a plurality of trampolines. The trampolines are jointly supported at the bottom of a bed frame or a flat plate.

Compared with the prior art, the present disclosure has the following technical effects.

The structure of the trampoline proposed in the present disclosure is novel and reasonable. Both ends of the elastic assembly are supported by vertical supporting units, and both the elastic assembly and an elastic support have elastic energy storage characteristics. The bending elastic energy storage characteristics of the elastic assembly and the excellent elastic energy storage characteristics of the elastic support are fully utilized, so that the overall elastic performance of the trampoline is obviously improved, the fluctuating amplitude of the elastic assembly is increased, and the friction noise generated when the elastic assembly rises and falls is eliminated. Meanwhile, the adverse effects of the turning angles (both ends are mutually gathered together) at both supported ends of the elastic plate and the change of the horizontal distance between both supported ends of the elastic plate due to the bending of the elastic plate on the support are also eliminated. The human body or other loads can move vertically up and down in the middle of the elastic assembly by means of the elastic deformation of the elastic assembly and the elastic support, so that the trampoline is beneficial to physical training, body building, entertainment and rehabilitation of people of different ages.

The elastic system proposed in the present disclosure is provided with the trampoline and has all the characteristics of the trampoline, and unnecessary details are not given here.

BRIEF DESCRIPTION OF THE DRAWINGS

To more clearly illustrate the present embodiment of the present disclosure or the technical scheme in the prior art, the following briefly introduces the attached figures to be used in the present embodiment. Apparently, the attached figures in the following description show merely some embodiments of the present disclosure, and those skilled in the art may still derive other drawings from these attached figures without creative efforts.

REFERENCE SIGNS IN THE ATTACHED FIGURES

100, trampoline;

1, elastic assembly; 11, first end; 12, second end; 13, rectangular elastic flat plate; 14, rectangular elastic frame; 15, supporting crossbar; 16, elastic fabric; 17, fabric buffer layer;

2, elastic support; 21, vertical supporting unit; 22, horizontal supporting unit; 23, horizontal elastic support plate; 24, horizontal elastic bar frame; 25, vertical elastic support plate; 26, vertical bar frame; 27, torsion spring;

3, elastic leg;
4, hinged connector;
5, elastic corner connector;
6, flexible corner connector;
7, buckle;
8, saddle seat;
9, follow-up armrest; and
10, pedal.

DETAILED DESCRIPTION OF THE EMBODIMENTS

The following clearly and completely describes the technical scheme in the embodiments of the present disclosure with reference to the embodiments of the present disclosure. Apparently, the described embodiments are merely a part rather than all of the embodiments of the present disclosure. Based on the embodiment in the present disclosure, all other embodiments acquired by the ordinary technical staff in the art under the premise of without contributing creative labor belong to the scope protected by the present disclosure.

One of the purposes of the present disclosure is to provide a novel trampoline. Through a bilaterally and elastically supported elastic assembly, the elastic performance of the trampoline can be improved, and the problems of the turning angles at both supported ends of the elastic plate and the change of the horizontal distance between both supported ends of the elastic plate due to the bending of the elastic assembly so as to limit the fluctuating amplitude of the elastic assembly and easily generate the friction noise in the prior art can also be solved.

The other of the purposes of the present disclosure is to further provide an elastic system provided with the trampoline.

To make the foregoing objective, features and advantages of the present disclosure clearer and more comprehensible, the present disclosure is further described in detail below with reference to the attached figures and specific embodiments.

Embodiment I

Figure 1:
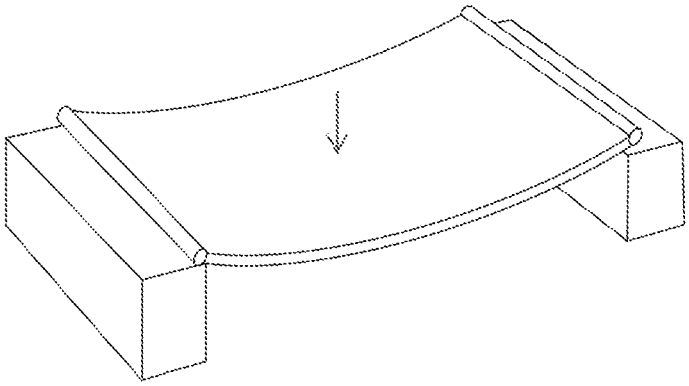
FIG. 1 is a schematic diagram of the deformation of a rectangular elastic flat plate when it is supported at both ends and is subjected to a downward force in the middle (arrows in the figure indicate the force direction of the elastic plate).
Figure 2:
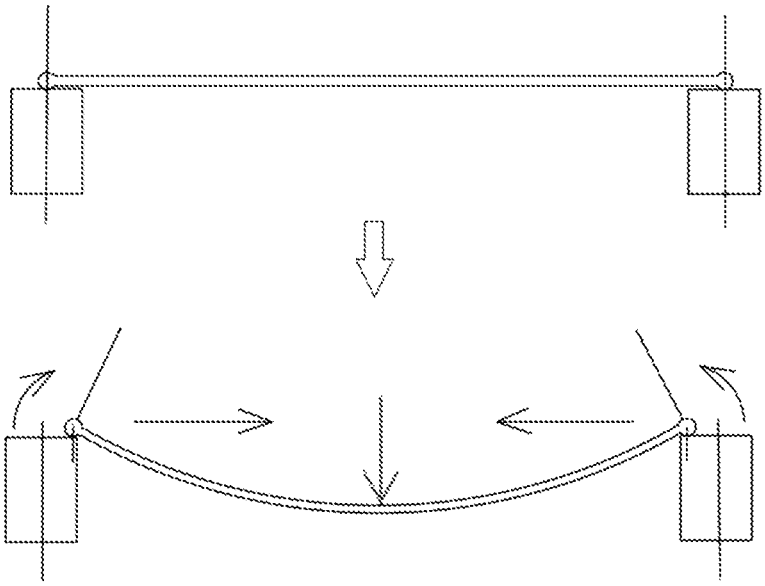
FIG. 2 is a principle diagram of the deformation of a rectangular elastic flat plate when it is supported at both ends and is subjected to a downward force in the middle (arrows in the figure indicate deformation directions of the rectangular elastic flat plate).
Figure 3:
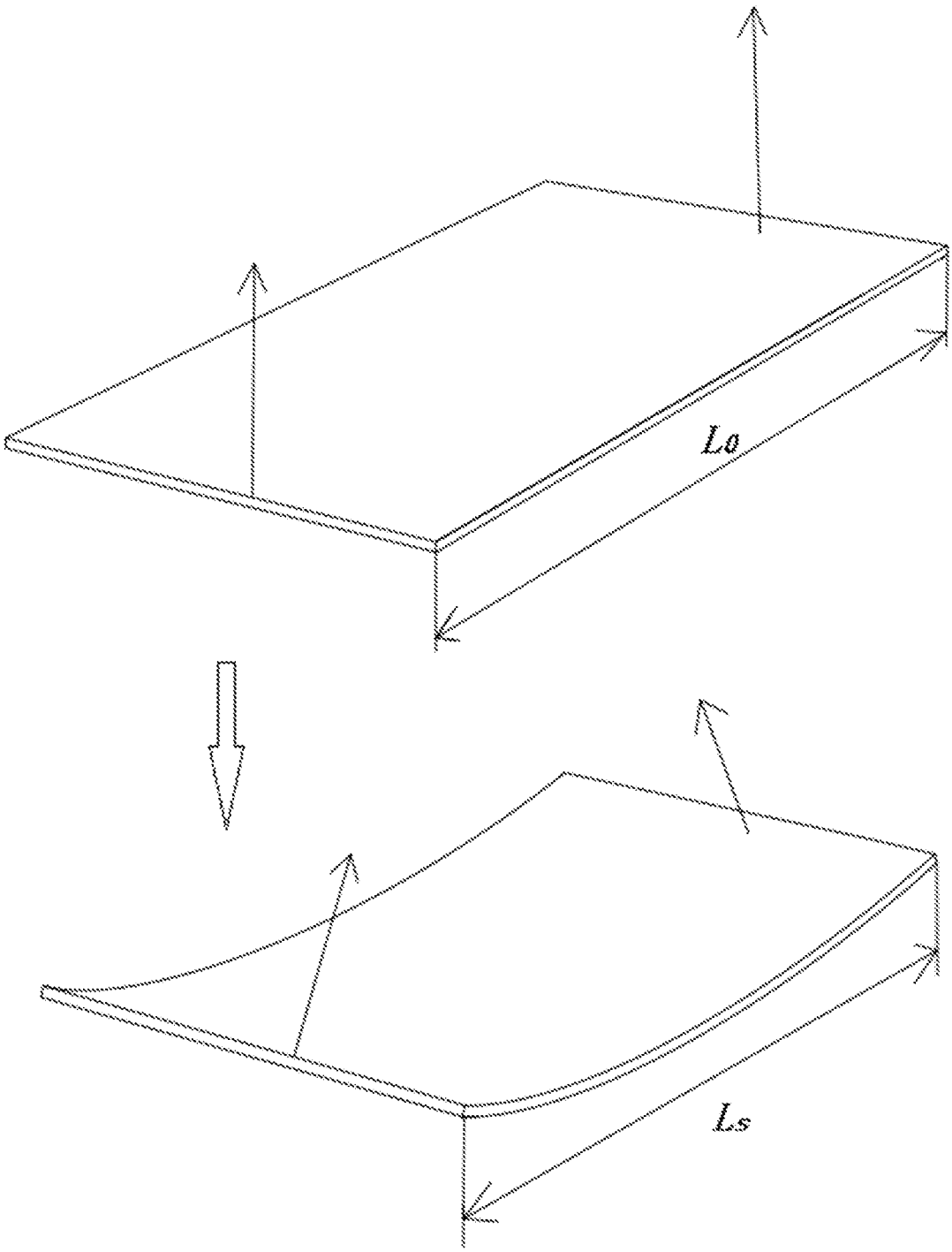
FIG. 3 is a principle diagram of the change of the horizontal distance between both ends when a rectangular elastic flat plate is bent (arrows in the figure indicate deformation directions of the rectangular elastic flat plate at both ends).
Figure 4:
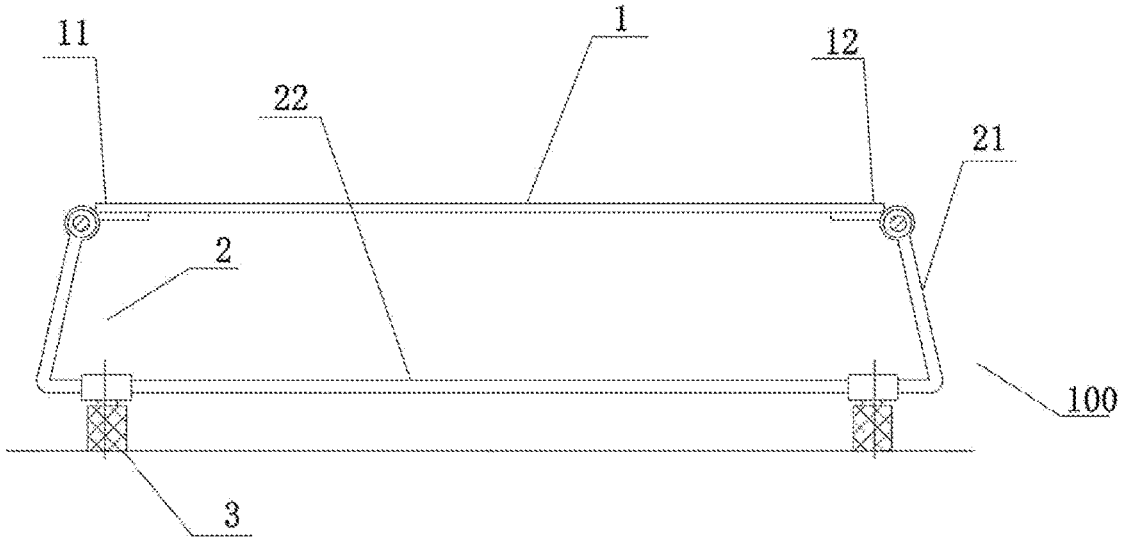
FIG. 4 is a structural schematic diagram of a trampoline disclosed in an embodiment of the present disclosure.
Figure 5:
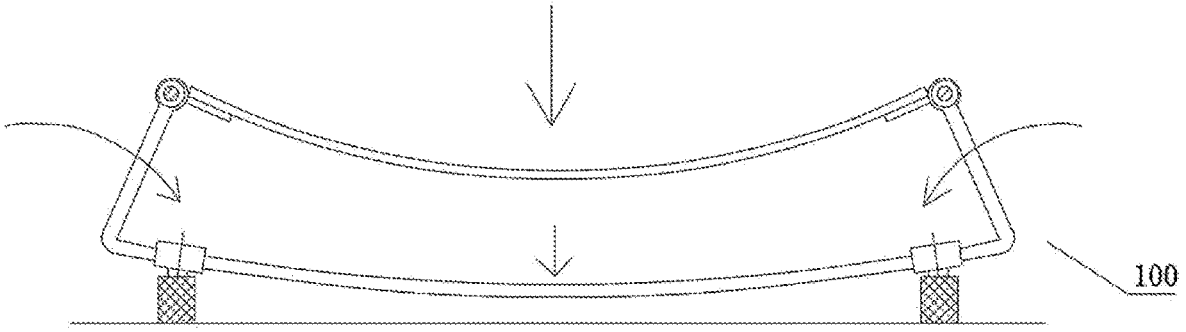
FIG. 5 is a principle diagram of the deformation of a trampoline as shown in FIG. 4.
Figure 6:
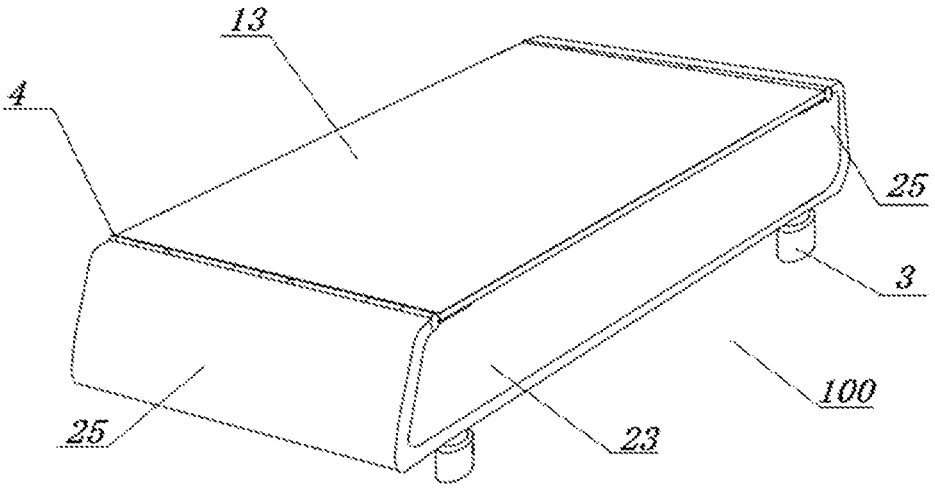
FIG. 6 is a structural schematic diagram of a trampoline wherein a connecting unit is a hinge disclosed in an embodiment of the present disclosure.
Figure 7:
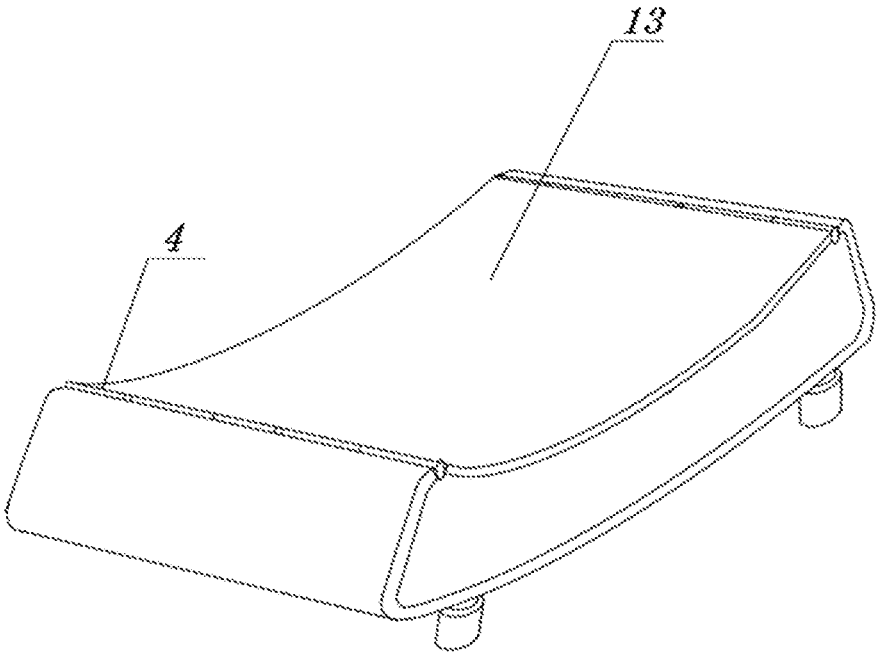
FIG. 7 is a principle diagram of the deformation of a trampoline as shown in FIG. 6.
Figure 8:
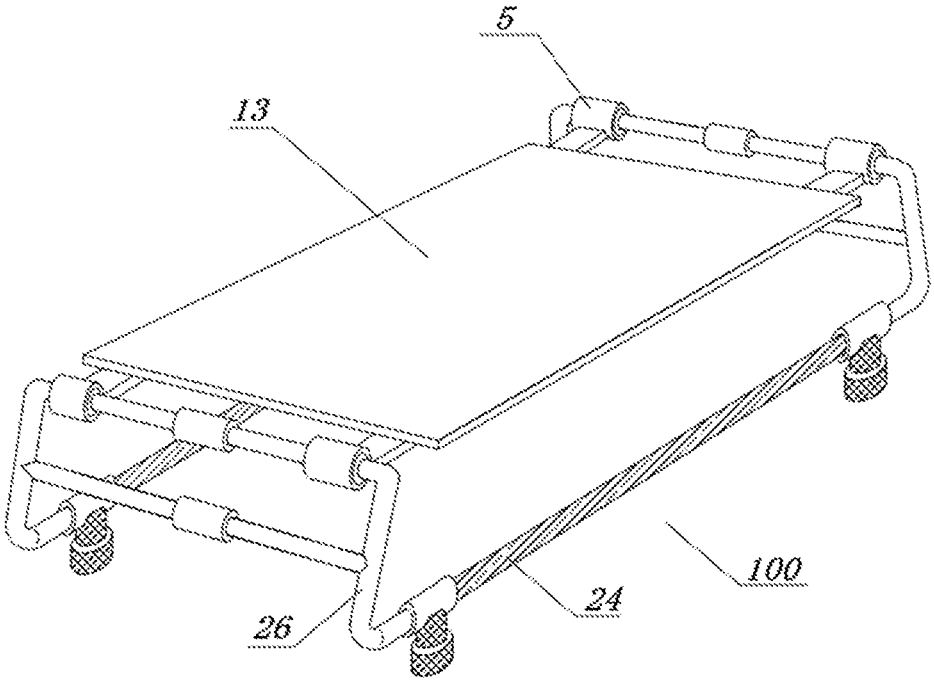
FIG. 8 is a structural schematic diagram of a trampoline wherein a connecting unit is an elastic corner connector disclosed in an embodiment of the present disclosure.
Figure 9:
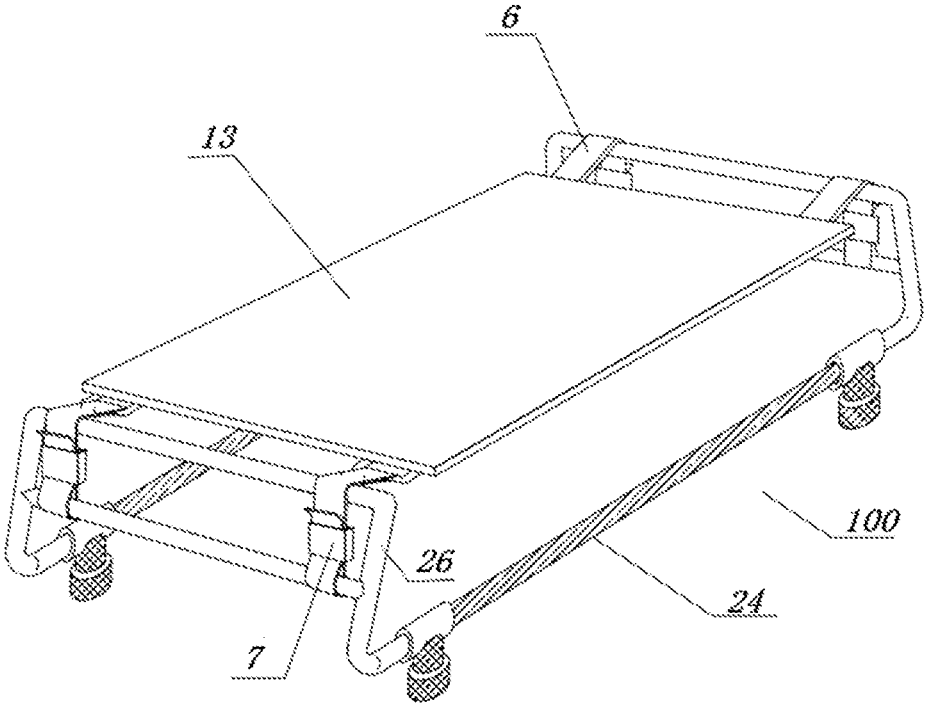
FIG. 9 is a structural schematic diagram of a trampoline wherein a connecting unit is a first kind of flexible corner connector disclosed in an embodiment of the present disclosure.
Figure 10:
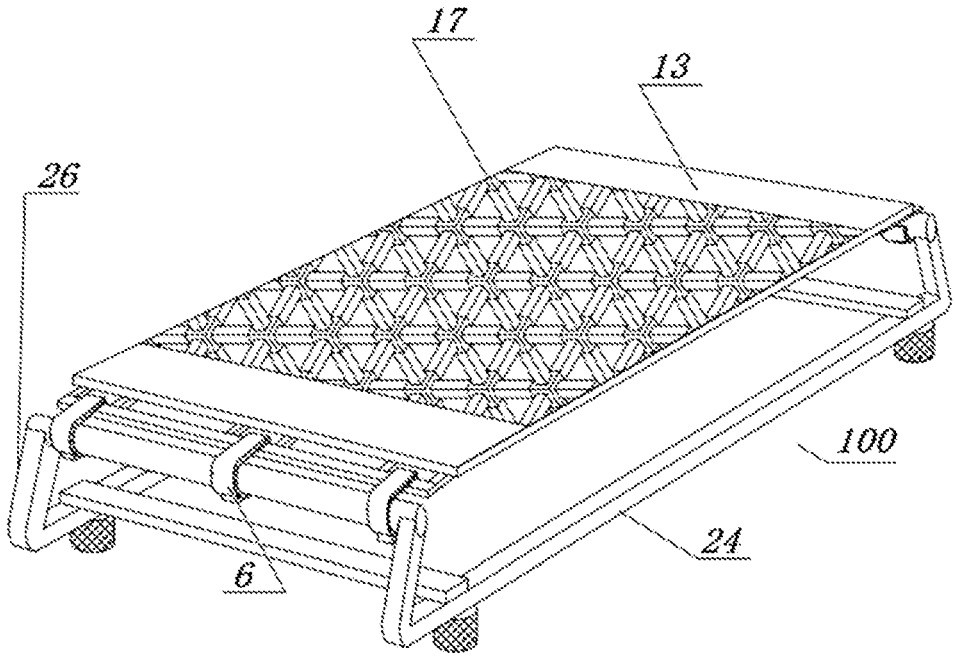
FIG. 10 is a structural schematic diagram of a trampoline wherein a connecting unit is a second kind of flexible corner connector disclosed in the embodiment of the present disclosure.
Figure 11:
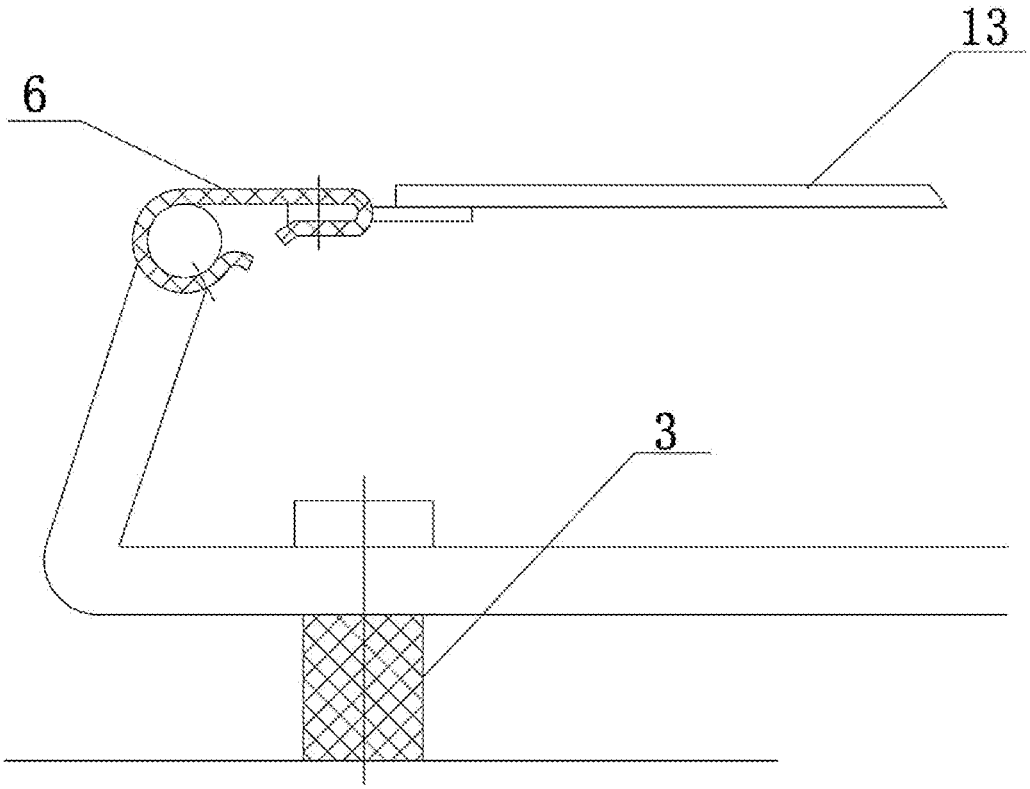
FIG. 11 is an amplified structural schematic diagram of a flexible corner connector in FIG. 10.
Figure 12:
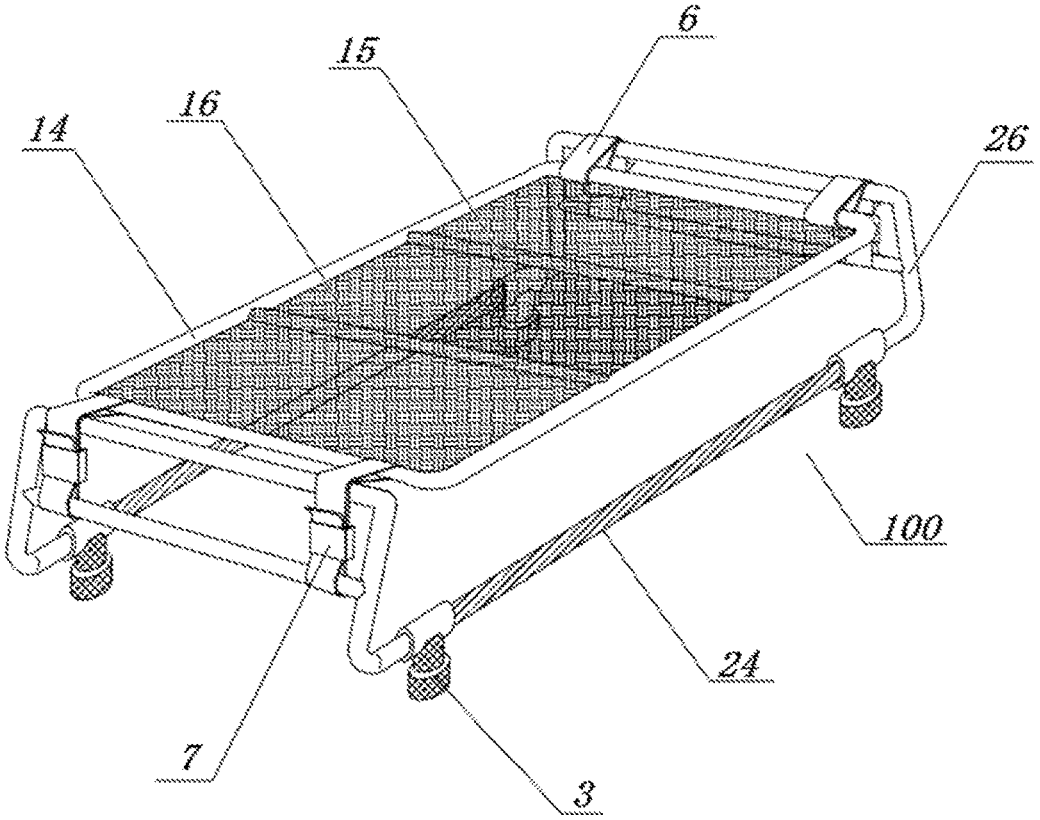
FIG. 12 is a structural schematic diagram of a trampoline wherein an elastic assembly includes a rectangular elastic frame disclosed in an embodiment of the present disclosure.
Figure 13:
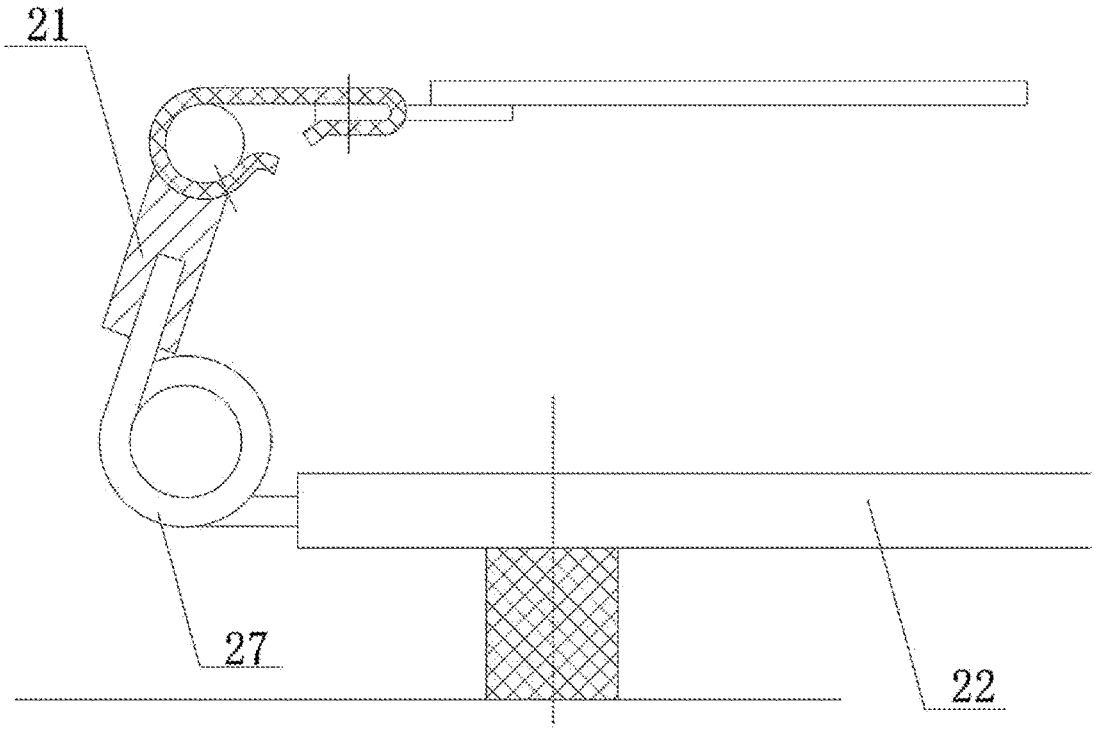
FIG. 13 is a schematic diagram of a vertical supporting unit and a horizontal supporting unit connected through a torsion spring disclosed in an embodiment of the present disclosure.

As shown in FIG. 4 and FIG. 5, the embodiment provides a trampoline 100 including an elastic assembly 1 and an elastic support 2. The elastic assembly 1 has a first end 11 and a second end 12. A portion, located between the first end 11 and the second end 12, of the elastic assembly 1 is a bendable energy accumulator for loading or standing. Generally, the elastic assembly 1 is preferably rectangular structure or of a structure of which the vertical projection is rectangular. The first end 11 and the second end 12 are both ends of the elastic assembly 1 in a length direction respectively. The elastic support 2 includes vertical supporting units 21 and a horizontal supporting unit 22. Two vertical supporting units 21 are arranged at intervals on the horizontal supporting unit 22. The two vertical supporting units 21 are respectively connected with the first end 11 and the second end 12 of the elastic assembly 1 through connecting units to bilaterally support and pre-tension the elastic assembly 1. The first end 11 and the second end 12 of the elastic assembly 1 are connected with the respective vertical supporting units 21 through a plurality of connecting units. The first end 11 and the second end 12 of the elastic assembly 1 are both in multi-point connection with the respective vertical supporting units 21 to avoid the elastic assembly 1 from rotating relative to the elastic support 2 during bending deformation of the elastic assembly, so that the stability of the trampoline can be promoted. Meanwhile, when the elastic assembly 1 is subjected to bending deformation, under the traction effect of the first end 11 and the second end 12 of the elastic assembly 1, at least one of the vertical supporting units 21 and the horizontal supporting unit 22 can be driven to be subjected to elastic bending deformation, so that symmetrical elastic reset force is applied on the first end 11 and the second end 12 of the elastic assembly 1, and the change of the horizontal distance between the first end 11 and the second end 12 in the bending deformation process of the elastic assembly 1 is limited (or called as "resisted"). When the middle part of the elastic assembly 1 is subjected to vertical force, the elastic assembly 1 is bent under pressure and turned (warped) at both ends, so that the horizontal distance between both ends of the elastic assembly 1 changes, which is an inevitable stress process during the use of the elastic assembly 1. Correspondingly, the vertical supporting units 21 supporting both ends of the elastic assembly 1 can also change with the change of the horizontal distance between both ends of the elastic assembly 1. However, since at least one of the vertical supporting units 21 (referring to two vertical supporting units 21) and the horizontal supporting unit 22 can be subjected to elastic bending deformation with the bending deformation of the elastic assembly 1, so that the elastic support 2 has certain elastic energy storage characteristics, and reaction force can be applied to both ends of the elastic assembly 1 when the horizontal distance between both ends of the elastic assembly 1 changes to help the middle part of the elastic assembly 1 to quickly reset, the overall deviation of the elastic assembly 1 when being bent under force is avoided, and the elastic force and support force of the elastic assembly 1 are improved.

In the embodiment, both ends of the elastic assembly 1 are supported by providing the elastic support 2 with elastic energy storage characteristics, so that the overall elastic performance of the trampoline 100 can be improved, the fluctuating amplitude of the elastic assembly 1 is increased, and the friction noise generated when the elastic assembly 1 rises and falls is eliminated. Meanwhile, the adverse effects of the turning angles (both ends are mutually gathered) at both supported ends of the elastic plate and the change of the horizontal distance between both supported ends of the elastic plate due to the bending of the elastic plate on the support are also eliminated. The human body or other loads can move vertically up and down in the middle of the elastic assembly 1 by means of the elastic deformation of the elastic assembly 1 and the elastic support 2, so that the trampoline is beneficial to physical training, body building, entertainment and rehabilitation of people of different ages. Thus, in the embodiment, both ends of the elastic assembly 1 by are supported by the vertical supporting unit 21*s*, so that a vertical fluctuating movement device with a bilaterally, integrally and elastically supported elastic assembly. The bending elastic energy storage characteristics of the elastic assembly 1 and the excellent elastic energy storage characteristics of the elastic support 2 are fully utilized, and the adverse effects of the turning angles at the first end 11 and the second end 12 and the change of the horizontal distance between the first end 11 and the second end 12 on the support effect of the elastic assembly 1 can be improved.

In the embodiment, two vertical supporting units 21 are symmetrically arranged at both ends of the horizontal supporting unit 22, and the elastic support 2 is of a U-shaped elastic support structure with both high ends and slightly lower middle part. The structure is similar to a bed frame structure. In order to ensure the elastic energy storage capacity of the overall elastic support 2, preferably, the two vertical supporting units 21 and the horizontal supporting unit 22 can be elastically bent and deformed with the bending deformation of the elastic assembly 1, that is, the elastic support 2 can be elastically deformed as a whole.

Further, in the embodiment, the horizontal supporting unit 22 may be a horizontal elastic support plate 23, or a horizontal elastic support frame comprising bar frames. Accordingly, each vertical supporting unit 21 may be a vertical elastic support plate 25, or a vertical elastic support frame comprising bar frames. The two structural forms of the horizontal supporting unit 22 and the two structural forms of the vertical supporting unit 21 can be arbitrarily combined in pairs. Generally, the horizontal supporting unit 22 and the vertical supporting unit 21 are in the same structural form. For example, the horizontal supporting unit 22 is a horizontal elastic support plate 23, and the vertical supporting unit 21 is a vertical elastic support plate 25 at this time. Similarly, when the horizontal supporting unit 22 is a horizontal elastic support frame comprising bar frames, the vertical supporting unit 21 is also a vertical elastic support frame comprising bar frames. For the purpose of distinguishing, bar frames constituting the horizontal elastic support frame are defined as "horizontal elastic bar frames 24" and bar frames constituting the vertical elastic support frame are defined as "vertical bar frames 26". Each horizontal elastic bar frame 24 and each vertical bar frame 26 may be of circular tube structures or square tube structures with a rectangular cross section.

The vertical supporting unit 21 and the horizontal supporting unit 22 can be made of metals with certain elasticity, engineering plastics or composite materials, such as metal materials with high strength and excellent elastic characteristics, glass fibers or carbon fiber composite materials, whether the unit is a support plate structure or a support frame structure. The cross-sectional structural parameters of the vertical supporting units 21 and the horizontal supporting unit 22 should ensure that the vertical supporting units 21 and the horizontal supporting unit 22 have necessary strength, stiffness and obvious elastic characteristics.

In practical application, the vertical supporting units 21 and the horizontal supporting unit 22 can be integrally formed. The vertical supporting units 21 and the elastic assembly 1 are roughly the same in widths. The two vertical supporting units 21 are separated from the outside of the first end 11 and the second end 12 of the elastic assembly 1, similar to a bed head with the same height as the elastic assembly 1, and can be tilted inward at a certain angle. The horizontal supporting unit 22, similar to a longitudinal beam of the bed frame, is fixed to the vertical supporting unit 21. Alternatively, the vertical supporting units 21 and the horizontal supporting unit 22 are connected through a torsion spring 27 (a strong torsion spring is generally used) or a bending leaf spring. The connectors between the vertical supporting units 21 and the horizontal supporting unit 22 can also be replaced with a series of replaceable components with different elasticity or sizes so as to meet different requirements of force and size for the trampoline.

In the embodiment, elastic legs 3 are further provided. The elastic legs 3 are arranged at the bottom of the elastic support 2, and specifically can be arranged at the bottoms of or adjacent to fixedly connected points of the vertical supporting units 21 and the horizontal supporting unit 22. The elastic legs 3, similar to bed legs, make contact with the ground, and support the elastic support 2, so that the bottoms of the horizontal supporting units 22 of the elastic support 2 keep necessary distance from the ground to avoid the horizontal supporting unit 22 from making contact with the ground when being bent under force. When the elastic assembly 1 is subjected to bending deformation, the elastic legs 3 can be subjected to elastic bending deformation or vertical elastic deformation under the traction effect of the elastic support 2. As a preferred scheme, the elastic legs 3 can be elastic components made of elastic polymer materials, engineering plastics or metal materials, and can bear certain bending and relative vertical displacement of upper and lower ends.

In the embodiment, the elastic assembly 1 is a rectangular elastic flat plate 13. Both ends of the rectangular elastic flat plate 13 in the length direction are the first end 11 and the second end 12 respectively. The thickness of the rectangular elastic flat plate 13 is uniform, or the thickness is gradually reduced from the middle to both ends in the length direction. The length-width ratio of the rectangular elastic flat plate 13 is preferably greater than 1 and less than 10. The rectangular elastic flat plate 13 can be made of elastic thin plates, such as composite materials, wooden boards and metal plates, and the thickness dimension is less than one tenth of the side length dimension. Alternatively, the elastic assembly 1 is an arched elastic plate. The vertical projection of the arched elastic plate is rectangular. Both ends of the arched elastic plate in the length direction are the first end 11 and the second end 12 respectively. The thickness of the arched elastic plate is uniform, or the thickness is gradually reduced from the middle to both ends in the length direction. The length-width ratio of the arched elastic flat plate is preferably greater than 1 and less than 10. The arched elastic flat plate can be made of elastic thin plates, such as composite materials, wooden boards and metal plates, and the thickness dimension is less than one tenth of the side length dimension. Alternatively, the elastic assembly 1 includes a rectangular elastic frame 14. A plurality of supporting crossbars 15 arranged at intervals along a length direction of the rectangular elastic frame 14 are embedded inside the rectangular elastic frame 14. The supporting crossbars 15 are parallel to each other and uniformly distributed at intervals. The rectangular elastic frame 14 is internally covered with an elastic thin plate or elastic fabric 16. Both ends of the rectangular elastic frame 14 in the length direction are the first end 11 and the second end 12 respectively. The elastic fabric 16 woven from load-bearing ropes, nets and cloth used in the trampoline plays the same role as the rectangular elastic flat plate 13 in carrying human body weight and storing energy by bending elasticity, and is a brand-new trampoline. The rectangular elastic frame 14 and the supporting crossbars 15 can be made of glass fiber composite materials, carbon fiber composite materials or metal materials, are high in deformation energy storage capacity, and can realize an elastic function different from the traditional trampoline but similar to the elastic plate.

In the embodiment, the connecting units have a swing function and are used in groups. The first end 11 and the second end 12 of the elastic assembly 1 are respectively connected with the respective vertical supporting units 21 through two connecting units. Any one of the connecting units is one of a hinged connector 4, an elastic corner connector 5 and a flexible corner connector 6.

One end of the hinged connector 4 is connected with the first end 11 or the second end 12 of the elastic assembly 1, the other end of the hinged connector 4 is connected with the corresponding vertical supporting unit 21, the first end 11 or the second end 12 of the elastic assembly 1 are hinged with the corresponding vertical supporting unit 21 through the hinged connector 4. Hinged connection means that a certain turning angle can be formed without separation, and hinged connection can be realized by coaxial hinged connection of holes, shafts, bearings and shaft sleeves. In the embodiment, when horizontally arranged pipe fittings are arranged at the upper ends of the vertical supporting units 21 on the same side, one end of the hinged connector 4 can be provided with an outer sliding sleeve which is in shaft and sleeve fit with the horizontally arranged pipe fittings.

The elastic corner connector 5 is a polymer elastic component or a metal elastic component. One end of the elastic corner connector 5 is connected with the first end 11 or the second end 12 of the elastic assembly 1, and the other end of the elastic corner connector 5 is connected with the corresponding vertical supporting unit 21. Both ends of the elastic corner connector 5 can be elastically deformed by external force. The polymer elastic component or the metal elastic component can be a leaf spring, a coil spring and the like.

The flexible corner connector 6 is a connecting chain, a connecting rope or a connecting belt. A fixed end of the flexible corner connector 6 is directly connected with the corresponding vertical supporting unit 21 or is connected with the corresponding vertical supporting unit 21 through a spring. An adjusting end of the flexible corner connector 6 penetrates a connecting hole of the first end 11 or the second end 12 and then turns over to the fixed end, and is connected with the fixed end through a buckle 7 or a nylon buckle to adjust the length and tightness of the flexible corner connector 6. The flexible corner connector 6 specifically can be a chain, a rope and a belt. The first end 11, the second end 12 and the vertical supporting units 21 are all provided with corresponding lifting rings, lifting buckles and other structures for the flexible corner connector 6 to penetrate and connect. The characteristics of connection through suspenders and lifting rings are utilized. The flexible corner connector 6 is connected with the vertical supporting unit 21 by a spring to further improve and adjust the elastic performance of the trampoline.

In the embodiment, taking the elastic assembly 1 as a rectangular elastic flat plate 13 as an example, the rectangular elastic flat plate 13 can be at least one of A to E:

A, a surface plate, in which trapezoidal notches gradually becoming narrow are formed among a plurality of adjacent traction parts at both ends, so as to increase the amplitude of the elastic deformation of the rectangular elastic flat plate 13;

B, a composite board, of which the surface layer and the middle layer are made of different materials;

C, having longitudinal reinforcing ribs and reinforcing bars locally arranged at the bottom or surface of the rectangular elastic flat plate 13, and a reinforcing plate arranged in the middle (to avoid overbending in the middle);

D, having a fabric pulling reinforcing net or belt arranged at the bottom of the rectangular elastic flat plate 13;

E, having a polymer material buffer layer, a fabric buffer layer and a pad integrally or locally arranged on the surface of the rectangular elastic flat plate 13, and a polymer material buffer bottom pad arranged in the middle of the horizontal supporting unit 22 as a buffer capable of making touch with the ground.

Figure 14:
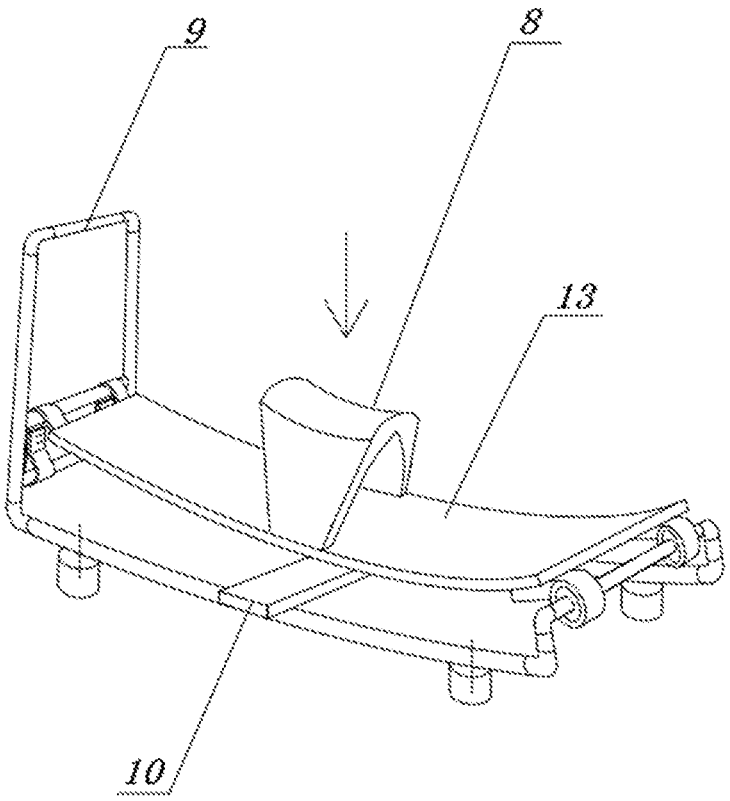
FIG. 14 is a structural schematic diagram of a trampoline wherein a saddle seat is installed disclosed in an embodiment of the present disclosure.

In the embodiment, a follow-up armrest 9 can be installed on the elastic assembly 1 or the vertical supporting units 22 as required, and a follow-up stool, a chair, a deck chair, a saddle seat 8, a pedal 10, a bed guard can be installed on the elastic assembly 1 to facilitate movement in different postures, body relaxation and health recovery. The follow-up bed frame or a slightly larger plate or other structural bodies can be installed on the elastic assemblies 1 of two trampolines 100 to achieve fluctuating movement experience. The elastic assembly 1 is provided with an electronic counter or a vibration sensor to display on the follow-up armrest 9, so that the number of vertical fluctuating movement is conveniently mastered. As shown in FIG. 14, the trampoline 100 is provided with a follow-up armrest 9, a saddle seat 8 and a pedal 10, which is an extension of the application of a vertical fluctuating movement device with a bilaterally, integrally and elastically supported elastic plate to simulate horse riding.

The operation principle of the trampoline 100 is described in detail below by taking the trampoline as an example in which the elastic assembly 1 is a rectangular elastic flat plate 13 and the rectangular elastic flat plate 13 is installed to the vertical supporting units 21 through the flexible corner connectors 6.

When the middle of the rectangular elastic flat plate 13 fluctuates up and down under the press of human body, the rectangular elastic flat plate 13 is bent, the first end 11 and the second end 12 are turned to change symmetrically. The horizontal distance between the first end 11 and the second end 12 tends to become shorter, and the distance between the tops of the two vertical supporting units 21 also tends to become shorter under the pull of the connecting units. Then, the vertical supporting units 21 and the horizontal supporting unit 22 are subjected to symmetrical elastic bending deformation to gather elastic potential energy, and the elastic legs 3 are deformed accordingly, the middle part of the rectangular elastic flat plate 13 is not subjected to obvious depression under the pull and support of the elastic support 2. When the pressure is decreased or disappears after spring back, the bending deformation of the rectangular elastic flat plate 13 is decreased or disappears, the elastic deformation corresponding to the elastic support 2 is simultaneously decreased or disappears, the deformation of the elastic legs 3 is decreased or disappears, the turning angles of the first end 11 and the second end 12 tend to reset, and the horizontal distance between the first end 11 and the second end 12 returns to an initial state. The elastic legs 3 are installed close to bending inflection points of the elastic support 2, so that the elastic legs 3 have a small displacement tendency when the horizontal supporting unit 22 is bent.

Thus, it can be seen that the trampoline 100 proposed in the technical scheme fully utilizes the excellent deep-bending energy storage and release characteristics of the elastic thin plate and superimposes the elastic energy storage effect supported by the integral elastic support, and provides a vertical undulating movement device for sports training, fitness, entertainment, body relaxation and rehabilitation with excellent body feeling, large fluctuating amplitude, low noise and small land occupation.

The trampoline 100 provided by the technical scheme adopts a correct and effective method to solve the problem of how to support when the elastic thin plate is bent under force so that both supported ends are subjected to turning and displacement. At the same time, energy is stored by the bending deformation of the integral elastic support 2, so that the fluctuating movement device with an elastic plate has better elastic characteristics.

Embodiment II

The present disclosure provides an elastic system, including a plurality of trampolines 100 disclosed in the first embodiment. The trampolines 100 are jointly supported at the bottom of a bed frame or a flat plate. For example, the follow-up bed frame or a slightly larger plate or other structural bodies can be installed on the elastic assembly 1 of two trampolines 100 to achieve fluctuating movement experience.

It needs to be noted that for those skilled in the art, obviously the present disclosure is not limited to the details of the exemplary embodiment, and the present disclosure can be achieved in other specific forms without departing from the spirit or essential characteristics of the present disclosure. Therefore, for every point, the embodiments should be regarded as exemplary embodiments and are unrestrictive, the scope of the present disclosure is restricted by the claims appended hereto, therefore, all changes, including the meanings and scopes of equivalent elements, of the claims are aimed to be included in the present disclosure, and any mark of attached figures in the claims should not be regarded as limitation to the involved claims.

Specific examples are used for illustration of the principles and implementation methods of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In summary, the contents of this specification should not be understood as the limitation of the present disclosure.

What is claimed is:

1. A trampoline, comprising:

an elastic assembly having a first end and a second end, wherein a portion, located between the first end and the second end, of the elastic assembly is a bendable energy accumulator; and an elastic support including vertical supporting units and a horizontal supporting unit, wherein two of the vertical supporting units are separately arranged on the horizontal supporting unit, the two vertical supporting units are respectively connected with the first end and the second end of the elastic assembly via connecting units to bilaterally support and pre-tension the elastic assembly, and the elastic assembly, when being subjected to a bending deformation, is capable of making at least one of the vertical supporting units and the horizontal supporting unit to be subjected to an elastic bending deformation, so as to apply symmetrical elastic reset force to the first end and the second end of the elastic assembly, and limit a change of a horizontal distance between the first end and the second end during the bending deformation of the elastic assembly.

2. The trampoline according to claim 1, wherein the horizontal supporting unit is a horizontal elastic support plate, or a horizontal elastic support frame comprising bar frames;

each of the vertical supporting units is a vertical elastic support plate, or a vertical elastic support frame comprising bar frames, and the vertical supporting units are symmetrically arranged at both ends of the horizontal support unit to form a U-shaped elastic support.

3. The trampoline according to claim 2, wherein the vertical supporting units and the horizontal supporting unit are integrally formed; or, the vertical supporting units and the horizontal supporting unit are connected through torsion springs or bending leaf springs.

4. The trampoline according to claim 3, further comprising elastic legs, wherein the elastic legs are arranged at a bottom of the elastic frame so as to support the elastic support, and when the elastic assembly is subjected to a bending deformation, the elastic legs is subjected to an elastic bending deformation or a vertical elastic deformation.

5. The trampoline according to claim 2, further comprising elastic legs, wherein the elastic legs are arranged at a bottom of the elastic frame so as to support the elastic support, and when the elastic assembly is subjected to a bending deformation, the elastic legs is subjected to an elastic bending deformation or a vertical elastic deformation.

6. The trampoline according to claim 2, wherein the elastic assembly is a rectangular elastic flat plate, both ends of the rectangular elastic flat plate in a length direction are the first end and the second end respectively, and the rectangular elastic flat plate has a uniform thickness, or has a thickness which is gradually reduced from middle to both ends in the length direction;

or, the elastic assembly is an arched elastic plate, a vertical projection of the arched elastic plate is rectangular, both ends of the arched elastic plate in the length direction are the first end and the second end respectively, and the arched elastic plate has a uniform thickness, or has a thickness which is gradually reduced from the middle to both ends in the length direction;

or, the elastic assembly comprises a rectangular elastic frame, a plurality of supporting crossbars arranged at intervals along a length direction of the rectangular elastic frame are embedded inside the rectangular elastic frame, the rectangular elastic frame is internally covered with an elastic thin plate or elastic fabric, and both ends of the rectangular elastic frame in the length direction are the first end and the second end respectively.

7. The trampoline according to claim 1, further comprising elastic legs, wherein the elastic legs are arranged at a bottom of the elastic support so as to support the elastic support, and when the elastic assembly is subjected to a bending deformation, the elastic legs are subjected to an elastic bending deformation or a vertical elastic deformation.

8. The trampoline according to claim 1, wherein the elastic assembly is a rectangular elastic flat plate, both ends of the rectangular elastic flat plate in a length direction are the first end and the second end respectively, and the rectangular elastic flat plate has a uniform thickness, or has a thickness which is gradually reduced from middle to both ends in the length direction;

or, the elastic assembly is an arched elastic plate, a vertical projection of the arched elastic plate is rectangular, both ends of the arched elastic plate in the length direction are the first end and the second end respectively, and the arched elastic plate has a uniform thickness, or has a thickness which is gradually reduced from the middle to both ends in the length direction;

or, the elastic assembly comprises a rectangular elastic frame, a plurality of supporting crossbars arranged at intervals along a length direction of the rectangular elastic frame are embedded inside the rectangular elastic frame, the rectangular elastic frame is internally covered with an elastic thin plate or elastic fabric, and both ends of the rectangular elastic frame in the length direction are the first end and the second end respectively.

9. The trampoline according to claim 8, also comprising at least one of a bottom reinforcing structure, a top reinforcing structure and a top surface buffer structure, wherein the bottom reinforcing structure comprises reinforcing ribs, a reinforcing plate and/or a fabric pulling reinforcing net and belt arranged on a bottom surface of the elastic assembly; the top reinforcing structure comprises reinforcing ribs and/or a reinforcing plate arranged on a top surface of the elastic assembly; and the top surface buffer structure comprises a polymer material buffer layer or a fabric buffer layer arranged on the top surface of the elastic assembly.

10. The trampoline according to claim 8, wherein the first end and the second end of the elastic assembly are connected with respective vertical supporting units through two connecting units respectively; any one of the two connecting units is one of a hinged connector, an elastic corner connector and a flexible corner connector;

one end of the hinged connector is connected with the first end or the second end of the elastic assembly, an other end of the hinged connector is connected with a corresponding one of the vertical supporting units, the first end or the second end of the elastic assembly are hinged with the corresponding one of the vertical supporting units through the hinged connector;

the elastic corner connector is a polymer elastic component or a metal elastic component, one end of the elastic corner connector is connected with the first end or the second end of the elastic assembly, an other end of the elastic corner connector is connected with a corresponding one of the vertical supporting units, and both ends of each elastic corner connector are capable of being elastically deformed by external forces;

the flexible corner connector is a connecting chain, a connecting rope or a connecting belt, a fixed end of the flexible corner connector is directly connected with a corresponding one of the vertical supporting units or is connected with the corresponding one of the vertical supporting units through a spring, an adjusting end of the flexible corner connector penetrates through a connecting hole of the first end or the second end and then turns over to the fixed end, and is connected with the fixed end through a buckle to adjust a length and tightness of the flexible corner connector.

11. The trampoline according to claim 8, wherein the elastic assembly is provided with an electronic counter or a vibration sensor so as to count number of bending deformation of the elastic assembly.

12. The trampoline according to claim 8, wherein the elastic assembly is also provided with at least one of a stool, a chair and a saddle seat; and the elastic support is also provided with a follow-up armrest.

13. An elastic system, comprising the trampoline according to claim 1, wherein the trampoline comprises a plurality of trampolines that are jointly supported at a bottom of a bed frame or a flat plate.

14. The elastic system according to claim 13, wherein the horizontal supporting unit is a horizontal elastic support plate, or a horizontal elastic support frame comprising bar frames;

each of the vertical supporting units is a vertical elastic support plate, or a vertical elastic support frame comprising bar frames, and the vertical supporting units are symmetrically arranged at both ends of the horizontal support unit to form a U-shaped elastic support.

15. The elastic system according to claim 14, wherein the vertical supporting units and the horizontal supporting unit are integrally formed; or, the vertical supporting units and the horizontal supporting unit are connected through torsion springs or bending leaf springs.

16. The elastic system according to claim 13, further comprising elastic legs, wherein the elastic legs are arranged at a bottom of the elastic support so as to support the elastic support, and when the elastic assembly is subjected to a bending deformation, the elastic legs are subjected to an elastic bending deformation or a vertical elastic deformation.

17. The elastic system according to claim 13, wherein the elastic assembly is a rectangular elastic flat plate, both ends of the rectangular elastic flat plate in a length direction are the first end and the second end respectively, and the rectangular elastic flat plate has a uniform thickness, or has a thickness which is gradually reduced from middle to both ends in the length direction;

or, the elastic assembly is an arched elastic plate, a vertical projection of the arched elastic plate is rectangular, both ends of the arched elastic plate in the length direction are the first end and the second end respectively, and the arched elastic plate has a uniform thickness, or has a thickness which is gradually reduced from the middle to both ends in the length direction;

or, the elastic assembly comprises a rectangular elastic frame, a plurality of supporting crossbars arranged at intervals along a length direction of the rectangular elastic frame are embedded inside the rectangular elastic frame, the rectangular elastic frame is internally covered with an elastic thin plate or elastic fabric, and both ends of the rectangular elastic frame in the length direction are the first end and the second end respectively.

18. The elastic system according to claim 17, also comprising at least one of a bottom reinforcing structure, a top reinforcing structure and a top surface buffer structure, wherein the bottom reinforcing structure comprises reinforcing ribs, a reinforcing plate and/or a fabric pulling reinforcing net and belt arranged on a bottom surface of the elastic assembly; the top reinforcing structure comprises reinforcing ribs and/or a reinforcing plate arranged on a top surface of the elastic assembly; and the top surface buffer structure comprises a polymer material buffer layer or a fabric buffer layer arranged on the top surface of the elastic assembly.

19. The elastic system according to claim 17, wherein the first end and the second end of the elastic assembly are connected with respective vertical supporting units through two connecting units respectively; any one of the two connecting units is one of a hinged connector, an elastic corner connector and a flexible corner connector;

one end of the hinged connector is connected with the first end or the second end of the elastic assembly, an other end of the hinged connector is connected with a corresponding one of the vertical supporting units, the first end or the second end of the elastic assembly are hinged with the corresponding one of the vertical supporting units through the hinged connector;

the elastic corner connector is a polymer elastic component or a metal elastic component, one end of the elastic corner connector is connected with the first end or the second end of the elastic assembly, an other end of the elastic corner connector is connected with a corresponding one of the vertical supporting units, and both ends of each elastic corner connector are capable of being elastically deformed by external forces;

the flexible corner connector is a connecting chain, a connecting rope or a connecting belt, a fixed end of the flexible corner connector is directly connected with a corresponding one of the vertical supporting units or is connected with the corresponding one of the vertical supporting units through a spring, an adjusting end of the flexible corner connector penetrates through a connecting hole of the first end or the second end and then turns over to the fixed end, and is connected with the fixed end through a buckle to adjust a length and tightness of the flexible corner connector.

20. The elastic system according to claim 17, wherein the elastic assembly is provided with an electronic counter or a vibration sensor so as to count number of bending deformation of the elastic assembly.

* * * * *